US009053879B2

(12) United States Patent
Lammers

(10) Patent No.: US 9,053,879 B2
(45) Date of Patent: Jun. 9, 2015

(54) ELECTROMAGNETIC ACTUATOR

(71) Applicant: Arend Lammers, TV Hengelo (NL)

(72) Inventor: Arend Lammers, TV Hengelo (NL)

(73) Assignee: EATON INDUSTRIES (NETHERLANDS) B.V., Hengelo (NL)

( * ) Notice: Subject to any disclaimer, the term of this patent is extended or adjusted under 35 U.S.C. 154(b) by 0 days.

(21) Appl. No.: 14/360,676

(22) PCT Filed: Nov. 27, 2012

(86) PCT No.: PCT/EP2012/073675
§ 371 (c)(1),
(2) Date: May 27, 2014

(87) PCT Pub. No.: WO2013/079463
PCT Pub. Date: Jun. 6, 2013

(65) Prior Publication Data

US 2014/0327502 A1 Nov. 6, 2014

(30) Foreign Application Priority Data

Nov. 29, 2011 (EP) ..... 11191035

(51) Int. Cl.

| | |
|---|---|
| ***H01H 51/22*** | (2006.01) |
| ***H01H 36/00*** | (2006.01) |
| ***H01H 53/015*** | (2006.01) |
| ***H01H 51/01*** | (2006.01) |
| ***H01F 7/16*** | (2006.01) |
| *H01H 33/666* | (2006.01) |

(52) U.S. Cl.
CPC ..... *H01H 36/00* (2013.01); *H01H 53/015* (2013.01); *H01H 2036/0086* (2013.01); *H01H 51/22* (2013.01); *H01H 51/01* (2013.01); *H01H 51/2209* (2013.01); *H01F 7/1615* (2013.01); *H01H 33/6662* (2013.01)

(58) Field of Classification Search
CPC ... H01H 51/01; H01H 51/22; H01H 51/2209; H01H 51/2218
USPC ..... 335/179, 229–234
See application file for complete search history.

(56) References Cited

U.S. PATENT DOCUMENTS 6,538,541 B1 * 3/2003 Kralik ..... 335/177

FOREIGN PATENT DOCUMENTS

| | | | |
|---|---|---|---|
| JP | 2002270423 | A | 9/2002 |
| JP | 2007073580 | A | 3/2007 |
| JP | 2007073829 | A | 3/2007 |
| JP | 2007103243 | A | 4/2007 |
| JP | 1826784 | A2 | 8/2007 |
| JP | 2330609 | A1 | 6/2011 |
| WO | WO 2004100198 | A1 | 11/2004 |

* cited by examiner

*Primary Examiner* — Ramon Barrera
(74) *Attorney, Agent, or Firm* — Leydig, Voit & Mayer, Ltd.

(57) ABSTRACT

An electromagnetic actuator for operating at least one movable contact of a switch into a switched-on position or a switched-off position, the actuator having: a static pole body; a movable pole body movable relative to the static pole body; a first magnetic circuit with a first coil for making the movable pole body and the fixed pole body move towards each other to a switched-on position and a second coil for making the movable pole body and the fixed pole body move away from each other to a switched-off position; and a second magnetic circuit with a permanent magnet and a retaining plate to keep the static pole body and the movable pole body in the switched-on position; first spring unit for urging the static pole body and the movable body away from each other; wherein the first and second magnetic circuit are arranged concentrically.

19 Claims, 1 Drawing Sheet

ELECTROMAGNETIC ACTUATOR

CROSS-REFERENCE TO RELATED APPLICATIONS

This application is a U.S. National Stage application under 35 U.S.C. §371 of International Application No. PCT/EP2012/073675, filed on Nov. 27, 2012, and claims benefit to European Patent Application No. 11191035.2, filed on Nov. 29, 2011. The International Application was published in English on Jun. 6, 2013, as WO 2013/079463 A1 under PCT Article 21(2).

FIELD

The invention relates to an electromagnetic actuator for operating at least one movable contact of a switch into a switched-on position or a switched-off position.

BACKGROUND

WO 2004100198 describes an electromagnetic actuator for operating a switch. This actuator has a coil for pulling two pole bodies together. A permanent magnet is provided to keep the pole bodies together, even if the coil is not powered. To disconnect the contact in the switch a second coil is provided, which cancels the magnetic force of the permanent magnet. A spring is provided to urge the pole bodies away from each other.

Both coils and the permanent magnet are arranged axially and behind each other. This results in a relative long actuator. Also due to this arrangement, the coil to return the contacts to the open position, need also be arranged axially and are typically arranged outside of the actuator.

Because the first and second coil are arranged axially behind each other, the manufacturing of the pole bodies is difficult due to the complex structure.

SUMMARY

An aspect of the invention provides a electromagnetic actuator for operating at least one movable contact of a switch into a switched-on position or a switched-off position, the electromagnetic actuator comprising: a static pole body; a movable pole body movable relative to the static pole body; a first magnetic circuit including a first coil, configured to make the movable pole body and the static pole body move towards each other to a switched-on position, and a second coil configured to make the movable pole body and the static pole body move away from each other to a switched-off position; and a second magnetic circuit including a permanent magnet configured to keep the static pole body and the movable pole body in the switched-on position; and first spring unit configured to urge the static pole body and the movable body away from each other, wherein the first and second magnetic circuit are arranged concentrically.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
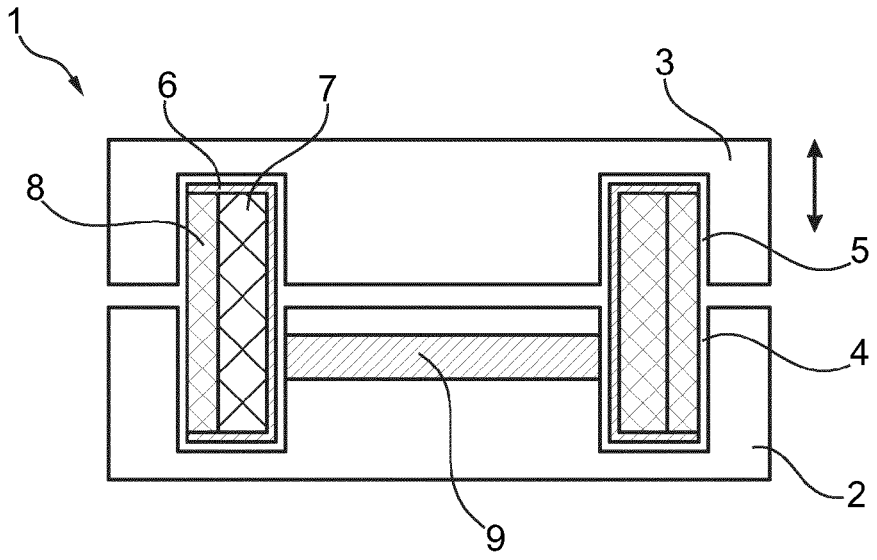
FIG. 1 shows a cross sectional view of a first embodiment of an actuator according to the invention.

An aspect of the invention provides a more compact actuator than prior art actuators. Another aspect provides an electromagnetic actuator for operating at least one movable contact of a switch into a switched-on position or a switched-off position, preferably an electromagnetic actuator used in medium and high voltage switch gear, used to bring the contacts of a switch together or to bring the contacts apart.

An aspect of the invention provides an electromagnetic actuator, which comprises:

- a static pole body;
- a movable pole body movable relative to the static pole body;
- a first magnetic circuit comprising a first coil for making the movable pole body and the fixed pole body move towards each other to a switched-on position and a second coil for making the movable pole body and the fixed pole body move away from each other to a switched-off position; and
- a second magnetic circuit comprising a permanent magnet to keep the static pole body and the movable pole body in the switched-on position;
- first spring means for urging the static pole body and the movable body away from each other;

wherein the first and second magnetic circuit are arranged concentrically.

By arranging the first and second magnetic circuit concentrically, the length of the actuator is substantially reduced. The first and second magnetic circuits are arranged concentrically and thus in substantially the same plane. So, the overall length of the actuator is reduced because the first and second magnetic circuits are nested. If the actuator according to the invention is viewed in radial direction, the first and second magnetic circuit are arranged overlapping.

Another advantage of the actuator according to the invention is, that due to the concentric arrangement, the pole bodies are more simple and therefore easier to manufacture. In contrast to the actuators of the prior art, the contact surfaces of the pole bodies are in a single plane, which simplifies manufacturing.

In a preferred embodiment of the electromagnetic actuator according to the invention the static pole body and the movable pole body comprise an annular recess for at least partial accommodation of the first and second coil.

The annular recess provides additional space for the coils, such that the length of the actuator is further reduced.

Preferably, the first magnetic circuit is arranged inside of the second magnetic circuit. With this configuration the first magnetic circuit and in particular the corresponding coil can have a smaller diameter, such that the generated closing force could be higher. This is necessary as the first magnetic circuit has to counteract the force of the spring means.

In yet another embodiment of the electromagnetic actuator according to the invention the first spring means comprise a spring concentrically arranged with the first and second magnetic circuit and between the static pole body and the movable pole body.

Although the spring could be arranged outside of the actuator as is known in the prior art, it is preferred to arrange the spring concentrically to obtain a further compact design of the actuator. Furthermore, this embodiment provides an actuator, which is fully functional and does not need an additional external spring, while still a more compact design is obtained.

Yet another embodiment of the electromagnetic actuator according to the invention further comprises an actuator rod arranged to the movable pole body.

Preferably, the actuator is arranged to the movable pole body by interposition of second spring means, wherein the second spring means are concentrically arranged with the first spring means.

The additional second spring means ensure that any play or changes in distance between the actuator and the contacts is accounted for. If the actuator according to the invention is used to actuate a vacuum interrupter, the second spring means can also compensate for the force of the bellows. Such a spring is typically present in prior art switch gear. However, by providing the second spring means concentrically within the actuator according to the invention a true compact actuator for a switch in medium and high voltage switch gear is obtained.

In still another embodiment of the electromagnetic actuator according to the invention the first and second coil of the first magnetic circuit are integrated in a single coil, wherein the pole bodies are moved to a switched-on position by powering the single coil and the pole bodies are moved away from each other by reverse powering the single coil.

FIG. 1 shows a first embodiment of an electromagnetic actuator 1 according to the invention. This actuator 1 has a static pole body 2 and an axially movable pole body 3. The static pole body 2 has a concentric recess 4 and the movable pole body 3 has a corresponding concentric recess 5.

The recesses 4 and 5 provide an annular space in which a coil frame 6 is arranged with a first coil 7 and a second coil 8.

A permanent magnet 9 is positioned concentrically inside of the concentric recess 4, in the static pole body 2.

During use of the electromagnetic actuator 1, an external spring will urge the pole bodies 2, 3 away from each other. A contact of a switch is connected to the movable pole body, such that the switch is open when the pole bodies 2, 3 are moved away from each other.

To turn the switch on and to bring the contacts of the switch together, the first coil 7, which constitutes a first magnetic circuit with both the pole bodies 2, 3, is powered. This will ensure that a magnetic field is created which will bring the two pole bodies 2, 3 together.

When the pole bodies 2, 3 are brought close or in contact with each other, the pole bodies 2, 3 will also be in the influence of the permanent magnet 9, which constitutes a second magnetic circuit. As soon as the movable pole body 3 is under the influence of the permanent magnet 9, the power on the first coil 7 can be cut. The permanent magnet 9 will ensure that the pole bodies will be kept in contact and accordingly will keep the connected switch closed.

To open the switch again, the second coil 8 is powered. This second coil 8 will generate a magnet field, which neutralizes the magnet field of the permanent magnet 9. Due to the external spring (not shown) urging the pole bodies 2, 3, the movable pole body 3 will move away from the static pole body 2 and open the connected switch.

Figure 2:
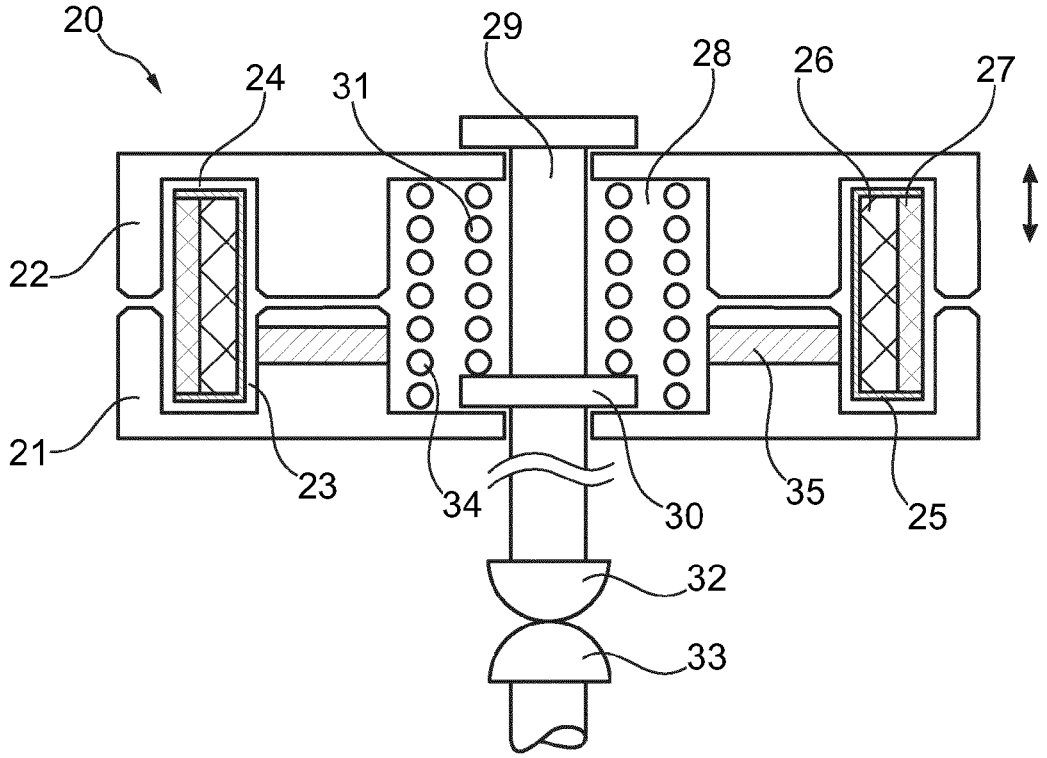
FIG. 2 shows a cross sectional view of a second embodiment of an actuator according to the invention.

FIG. 2 shows a second embodiment of an electromagnetic actuator 20 according to the invention. This actuator 20 has a static pole body 21 and a movable pole body 22. Both bodies 21, 22 are provided with a concentric recess 23, 24 respectively. These recesses 23, 24 provide an annular concentric space in which a coil frame 25 with a first coil 26 and a second coil 27 is provided.

A permanent magnet 35 is also concentrically arranged in the static pole body 21, as well as a concentrically arranged cylindrical space 28.

A drive rod 29 extends through the cylindrical space 28 and has a flange 30. A spring 31 is arranged between the flange 30 and the movable pole body 22. This spring 31 ensures that the contact 32 on the drive rod 29 will be kept in good contact with the other contact 33.

A further spring 34 is arranged in the cylindrical space to urge the static pole body 21 and the movable pole body 22 away from each other.

With this embodiment 20 all the necessary parts for actuating a switch 32,33 are arranged within the height of the static pole body 21 and the movable pole body 22.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. An electromagnetic actuator for operating at least one movable contact of a switch into a switched-on position or a switched-off position, the electromagnetic actuator comprising:

a static pole body;

a movable pole body movable relative to the static pole body;

a first magnetic circuit including a first coil, configured to make the movable pole body and the static pole body move towards each other to a switched-on position, and a second coil configured to make the movable pole body and the static pole body move away from each other to a switched-off position;

a second magnetic circuit including a permanent magnet configured to keep the static pole body and the movable pole body in the switched-on position; and a first spring unit configured to urge the static pole body and the movable body away from each other, wherein the first and second magnetic circuit are arranged concentrically, wherein the static pole body includes an annular recess for at least partial accommodation of the first and second coil, and wherein the movable pole body includes an annular recess for at least partial accommodation of the first and second coil.

2. The actuator of claim 1, wherein the first magnetic circuit is arranged inside of the second magnetic circuit.

3. The actuator of claim 1, wherein the first spring unit includes a spring, wherein the spring is concentrically arranged with the first and second magnetic circuit, and wherein the spring is arranged between the static pole body and the movable pole body.

4. The actuator of claim 1, further comprising:

an actuator rod arranged on the movable pole body.

5. The actuator of claim 4, further comprising:

a second spring unit interposed in the movable pole body by interposition, wherein the second spring unit is concentrically arranged with the first spring unit.

6. The actuator of claim 1, wherein the first and second coil of the first magnetic circuit are integrated in a single coil, wherein the static and movable pole bodies are moved to a switched-on position by powering the single coil, and wherein the static and movable pole bodies are moved away from each other by reverse powering the single coil.

7. The actuator of claim 1, further comprising:

an actuator rod arranged through the movable pole body.

8. The actuator of claim 4, wherein the static pole body is arranged with respect to the movable pole body by interposition of a second spring unit, wherein the second spring unit is concentrically arranged with the first spring unit.

9. The actuator of claim 1, wherein the first and second magnetic circuits are arranged in substantially the same plane.

10. The actuator of claim 1, comprising no spring external to the static and movable bodies.

11. An electromagnetic actuator for operating at least one movable contact of a switch into a switched-on position or a switched-off position, the electromagnetic actuator comprising:

a static pole body;

a movable pole body movable relative to the static pole body;

a first magnetic circuit including a first coil, configured to make the movable pole body and the static pole body move towards each other to a switched-on position, and a second coil configured to make the movable pole body and the static pole body move away from each other to a switched-off position;

a second magnetic circuit including a permanent magnet configured to keep the static pole body and the movable pole body in the switched-on position; and a first spring unit configured to urge the static pole body and the movable body away from each other, wherein the first and second magnetic circuit are arranged concentrically, wherein the first spring unit includes a spring, wherein the spring is concentrically arranged with the first and second magnetic circuit, and wherein the spring is arranged between the static pole body and the movable pole body.

12. The actuator of claim 11, wherein the static pole body includes an annular recess for at least partial accommodation of the first and second coil, and wherein the movable pole body includes an annular recess for at least partial accommodation of the first and second coil.

13. The actuator of claim 11, further comprising:

an actuator rod arranged on the movable pole body; and a second spring unit interposed in the movable pole body by interposition, wherein the second spring unit is concentrically arranged with the first spring unit.

14. The actuator of claim 11, further comprising:

an actuator rod arranged on the movable pole body, wherein the static pole body is arranged with respect to the movable pole body by interposition of a second spring unit, and wherein the second spring unit is concentrically arranged with the first spring unit.

15. The actuator of claim 11, comprising no spring external to the static and movable bodies.

16. An electromagnetic actuator for operating at least one movable contact of a switch into a switched-on position or a switched-off position, the electromagnetic actuator comprising:

a static pole body;

a movable pole body movable relative to the static pole body;

a first magnetic circuit including a first coil, configured to make the movable pole body and the static pole body move towards each other to a switched-on position, and a second coil configured to make the movable pole body and the static pole body move away from each other to a switched-off position;

a second magnetic circuit including a permanent magnet configured to keep the static pole body and the movable pole body in the switched-on position;

a first spring unit configured to urge the static pole body and the movable body away from each other, an actuator rod arranged on the movable pole body; and a second spring unit interposed in the movable pole body by interposition, wherein the first and second magnetic circuit are arranged concentrically, and wherein the second spring unit is concentrically arranged with the first spring unit.

17. The actuator of claim 16, wherein the static pole body includes an annular recess for at least partial accommodation of the first and second coil, and wherein the movable pole body includes an annular recess for at least partial accommodation of the first and second coil.

18. The actuator of claim 16, wherein the first spring unit includes a spring, wherein the spring is concentrically arranged with the first and second magnetic circuit, and wherein the spring is arranged between the static pole body and the movable pole body.

19. The actuator of claim 16, comprising no spring external to the static and movable bodies.

* * * * *